United States Patent [19]

Kuzukawa

[11] Patent Number: 5,017,898

[45] Date of Patent: May 21, 1991

[54] ELECTROMAGNETIC RELAY

[75] Inventor: Kiyoaki Kuzukawa, Ibaraki, Japan

[73] Assignee: Omron Corporation, Kyoto, Japan

[21] Appl. No.: 550,755

[22] Filed: Jul. 12, 1990

[30] Foreign Application Priority Data

Jul. 13, 1989 [JP] Japan ..... 1-182240

[51] Int. Cl.[5] ..... H01H 67/02

[52] U.S. Cl. ..... 335/128; 335/78; 337/140

[58] Field of Search ..... 337/140; 335/78-85, 335/45, 43, 128, 124

[56] References Cited

U.S. PATENT DOCUMENTS

| | | | |
|---|---|---|---|
| 3,810,059 | 5/1974 | Jost | 337/140 |
| 3,967,227 | 6/1976 | Clarke et al. | 337/140 |
| 4,535,309 | 8/1985 | Moreau et al. | 335/43 |
| 4,709,219 | 11/1987 | Nestlen et al. | 335/129 |
| 4,739,297 | 4/1988 | Fornasari | 337/120 |

OTHER PUBLICATIONS

"JETI" vol. 36, No. 7, pp. 179-189 published by Sekiyu Bunkasha in 1988.

*Primary Examiner*—Leo P. Picard
*Assistant Examiner*—Lincoln Donovan
*Attorney, Agent, or Firm*—Foley & Lardner

[57] ABSTRACT

An electromagnetic relay comprises a force transmitting member for displacing a movable contact point member as an armature moves, to come in contact with a fixed contact point member. A pressing portion of the force transmitting member which is in contact with the movable contact point member is formed of a shape memory material restoring a previously memorized shape at or above a predetermined temperature. The fixed contact point and the movable contact point are abraded resulted from the long-term use of the electromagnetic relay, thereby reducing contact pressure between the two contact points and correspondingly increasing contact resistance, so that the contact points overheats. While the pressing portion of the force transmitting member overheats corresponding thereto, it changes into a predetermined shape by exerting a shape memory effect at or above a predetermined temperature to increase the contact pressure between the movable contact point member and the fixed contact point member, thereby eliminating the overheating between the contact points.

5 Claims, 4 Drawing Sheets

ELECTROMAGNETIC RELAY

BACKGROUND OF THE INVENTION

The present invention relates generally to an electromagnetic relay in which a circuit is turned on and off or switched by the movement of electric contact points interlocking with an armature moved by attraction of an electromagnet.

Background Art

FIG. 1 is a schematic side view showing one example of an electromagnetic relay of this type. The electromagnetic relay comprises an electric insulating terminal mount 7, and an electromagnetic section A and a switch section B equipped on the terminal mount 7.

The electromagnetic section A comprises an electric insulating coil spool 2 with an electromagnetic coil 1 wound thereon, an iron core 3 disposed in a shaft of the coil spool 2, a yoke 4 disposed outside the electromagnetic coil 1, and an armature 5. A base end of the yoke 4 is bent and the bent portion is caulked at the base end of the iron coil 3. A free end portion 4*a* of the yoke 4 is located at the side of a top end pole-face 3*a* of the iron core 3 and contacts a flange portion of the coil spool 2.

The armature 5 has a hinge portion 5*b* rotatably supported by the free end portion 4*a* of the yoke 4. The armature is approximately L-shaped and has one end portion 5*a* disposed opposing the top end pole-face 3*a* of the iron core 3. A spring 6 is attached to the yoke 4. The spring 6 urges the armature 5 so as to always rotate in one direction. In other words, the spring 6 urges the one end portion 5*a* of the armature 6 in a direction away from the top end pole-face 3*a* of the iron core 3.

The switch section B comprises a fixed contact plate 8 and a movable contact plate 9. The fixed contact plate 8 and the movable contact plate 9 are disposed opposing to each other and attached on the terminal mount 7. The fixed contact plate 8 and the movable contact plate 9 have, at each free end portion thereof, contact points 8*a* and 9*a*, respectively. When the movable contact plate 9 moves toward the fixed contact plate 8, so that the contact points 8*a* and 9*a* come into contact with each other, the circuit is connected.

The electromagnetic relay further comprises an electric insulating card 10 functioning as a force transmitting member for transmitting the movement of the armature to the movable contact plate 9. The electric insulating card 10 has a base end 10*b* fixed to the other end portion 5*c* of the armature 5 and a pressing portion 10*a* provided protruding so as to be in contact with the movable contact plate 9.

When current flows in the magnetic coil 1, the iron core 3 is magnetized. One end portion 5*a* of the armature 5 is attracted by the magnetic force to rotate against the spring force of the spring 6 and then secured to the top end pole-face 3*a* of the iron core 3. Since the electric insulating card 10 is fixed to the other end portion of the armature 5, it moves as the armature 5 rotates, thereby displacing the movable contact plate 9 toward the fixed contact plate 8. Ultimately, as shown in FIG. 2A, the contact point (movable contact point) 9*a* of the movable contact plate 9 and the contact point (fixed contact point) 8*a* of the fixed contact plate 8 are made to contact with each other to connect the circuit. When the power supply to the magnetic coil 1 is stopped, the armature 5 rotates in a direction away from the top end pole-face 3*a* of the iron core 3 by the spring force of the spring 6. As the armature 5 rotates, the electric insulating card 10 moves so as to release the pressing force to the movable contact plate 9, resulting in the movable contact point 9*a* and the fixed contact point 8*a*separated from each other as shown in FIG. 1.

The electromagnetic relay of this type is designed such that the fixed contact point 8*a* and the movable contact point 9*a* come into contact with each other with predetermined contact pressure. Ordinarily, the contact pressure is set in the range from 10 to 20 gf. The contact pressure between the fixed contact point 8*a* and the movable contact point 9*a* acts as the reaction force to the electric insulating card 10. In other words, the contact pressure between the two contact points functions as the force to keep the armature 5 away from the top end pole-face 3*a* of the iron core 3. Therefore, if the contact pressure is set to exceed 20 gf, the magnetic force the electromagnet should be increased, for example, by increasing the number of windings of the magnetic coil 1. Corresponding thereto, the spring force of the spring 6 should be increased. Eventually, the contact pressure between the two contact points exceeding 20 gf makes the size of the electromagnetic relay larger. In order to make the size of the electromagnetic relay smaller, the contact pressure between the fixed contact point 8*a* and the movable contact point 9*a* is desirably 20 gf or below.

Meanwhile, if the contact pressure between the fixed contact point 8*a* and the movable contact point 9*a* is too small, on some occasions a small gap is generated between the fixed contact point 8*a* and the movable contact point 9*a* while they are in contact with each other, so that good electric connection might not be achieved. In addition, it is probable that arc is generated in the small gap between the two contact points, causing overheating between the contact points. From the view point of the foregoing, the contact pressure between the fixed contact point 8*a* and the movable contact point 9*a* is desirably 10 gf or above.

At the start of use of the electromagnetic relay, the fixed contact point 8*a* and the movable contact point 9*a* come into contact with each other with the predetermined contact pressure. However, as the switching operation between the two contact points is repeated during a long-term use of the electromagnetic relay, a contact portion between the fixed contact point 8*a* and the movable contact point 9*a* is abraded. Meanwhile, the moving stroke of the electric insulating card 10 is always constant. Namely, the pressing stroke of the pressing portion 10*a* of the electric insulating card 10 is always constant. Therefore, the contact pressure between the fixed contact point 8*a* and the movable contact point 9*a* is gradually reduced. As the contact pressure is reduced, there exists a small gap between the fixed contact point 8*a* and the movable contact point 9*a* as shown in FIG. 2B. As a result, contact resistance between the two contact points is increased, so that the two contact points heat up to a high temperature of, for example, 80° C. or more because of the Joule heat. In an extreme case, the arc might be generated in the small gap between the two contact points, thereby attaching the two contact points.

SUMMARY OF THE INVENTION

An object of the present invention is to provide an electromagnetic relay capable of, even if a fixed contact point and a movable contact point are abraded during a long-term use, maintaining contact pressure between the two contact points in a predetermined range.

Another object of the present invention is to provide an electromagnetic relay capable of preventing overheating due to the increased contact resistance.

Still another object of the present invention is to provide a long-life electromagnetic relay durable for a long-term use.

The electromagnetic relay according to the present invention comprises an electromagnetic section, a switch section and a force transmitting member. The electromagnetic section includes an electromagnet and an armature moved by the attraction force of the electromagnet. The switch section includes a fixed contact point member and a movable contact point member for switching the circuit. The force transmitting member includes a pressing portion in contact with the movable contact member and an attaching portion fixed to the armature, thereby displacing the movable contact point member as the armature moves and making the movable contact point member come into contact with the fixed contact point member. The pressing portion of the force transmitting member is formed of a shape memory material restoring a previously memorized shape when it is heated to a predetermined temperature or above.

When the movable contact point member and the fixed contact point member are abraded during a long-term use, contact pressure between the movable contact point and the fixed contact point is reduced. Corresponding thereto, contact resistance is increased, so that the contact point members overheat due to Joule heat. Corresponding thereto, a temperature of the pressing portion of the force transmitting member also rises. When the temperature of the pressing portion rises to a predetermined temperature or above, it restores the previously memorized shape because of the shape memory effect and restores the contact pressure between the movable contact point member and the fixed contact point member to a predetermined range.

The pressing portion of the force transmitting member is preferably formed of a shape memory resin having the shape memory effect. In order to efficiently achieve the above-described effect, the pressing portion of the force transmitting member is desirably formed of a shape memory resin whose length is increased at or above a predetermined temperature to restore a shape such that the contact pressure between the movable contact point member and the fixed contact point member is increased.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 3:
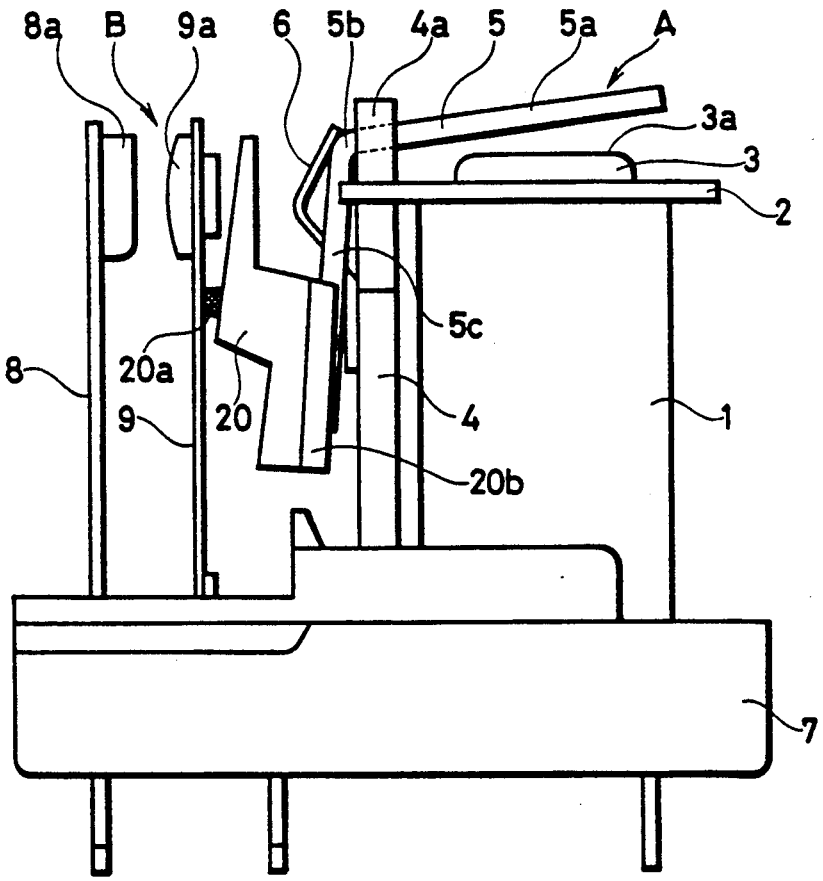
FIG. 3 is a schematic side view showing one embodiment of an electromagnetic relay according to the present invention.

FIG. 3 shows one embodiment of the present invention. In FIG. 3, the same reference numerals are allotted to the same elements as those shown in FIG. 1 and no detailed description will be made thereto.

Figure 1:
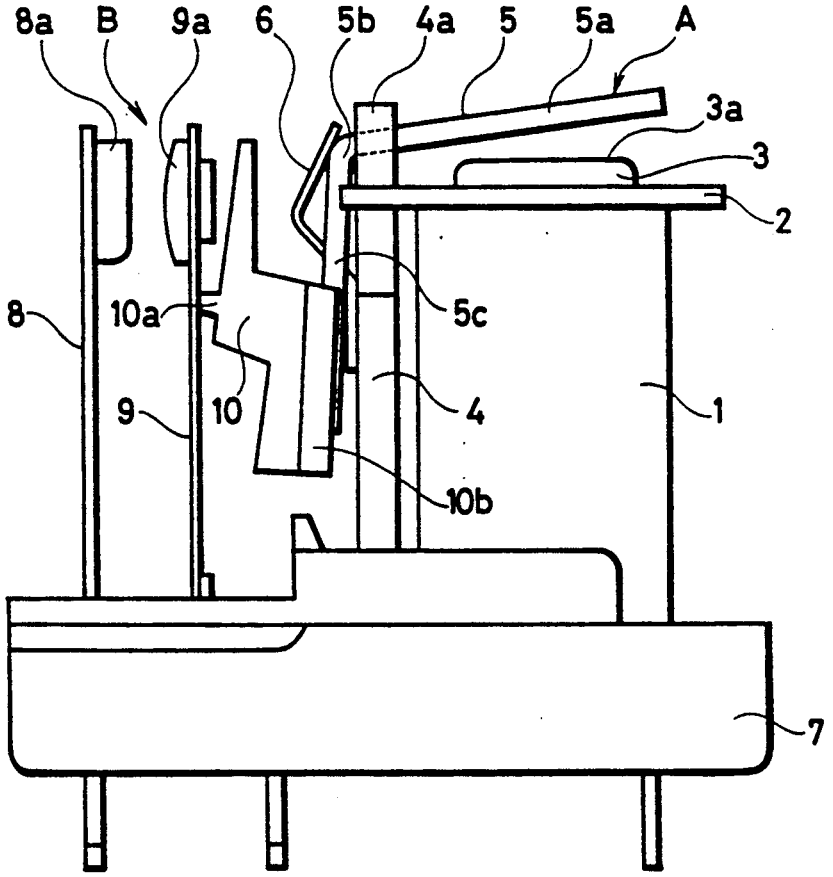
FIG.1 PRIOR ART
FIG. 1 is a schematic side view showing one example of a conventional electromagnetic relay.

The electromagnetic relay shown in FIG. 3, differs from that shown in FIG. 1 in a structure of an electric insulating card 20 functioning as a force transmitting member. The electric insulating card 20 includes an attaching portion **20*b* fixed to the armature 5 and a pressing portion 20*a* in contact with the movable contact plate 9. The pressing portion 20*a*** is formed of a shape memory resin restoring a previously memorized shape at or above a predetermined temperature.

In recent years, the shape memory resin has been developed that restores a previously memorized shape at or above a predetermined temperature. Polyisoprene resins, styrene-butadiene resins, polyurethane resins, and polynorbornen resins and the like are known as resins having the shape memory effect. The trans-polyisoprene having the shape memory effect is described in detail in the magazine entitled "JETI" vol. 36, No. 7, bpp. 179–189 published by SEKIYU BUNKASHA in 1988.

Figure 4A:
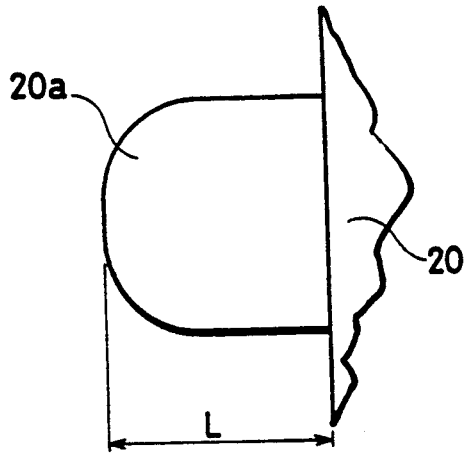
FIG. 4A is a schematic side view showing a pressing portion of a force transmitting member formed of a shape memory material.
Figure 4B:
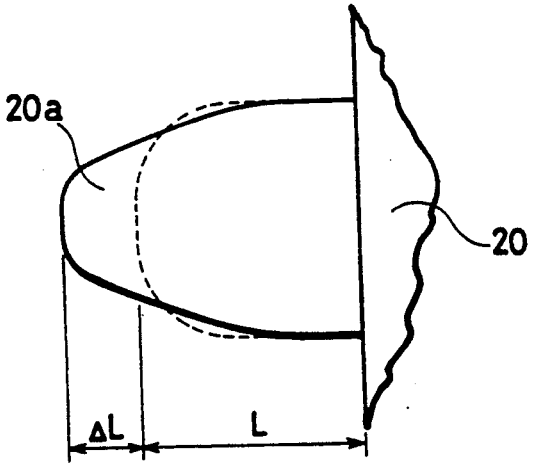
FIG. 4B is a schematic side view showing a state after the restoration of the pressing portion of the force transmitting member shown in FIG. 4A to a previously memorized shape.

We refer to FIGS. 4A and 4B showing of the pressing portion **20*a* of the electric insulating card 20. The pressing portion 20*a* is formed of a resin having the shape memory effect and it is previously processed so as to memorize the shape shown in FIG. 4B. In the state shown in FIG. 4B, a length of the pressing portion 20*a* is $L + \Delta L$. Before the start of use of the electromagnetic relay, the pressing portion 20*a* is plastically deformed to have a shape as shown in FIG. 4A. In the state shown in FIG. 4A, the length of the pressing portion 20*a*** is L.

It is desirable to form the pressing portion **20*a* of the electric insulating card 20 with shape memory resins which restores the previously memorized shape at or above about 80° C. In addition, difference ($\Delta L$) between the length (L) of the pressing portion 20*a* before the restoration of the shape and the length ($L+\Delta L$) of the pressing portion 20*a*** after the restoration of the shape is selected to maintain the contact pressure between the fixed contact point and the movable contact point in the range from 10 to 20 gf.

Figure 5A:
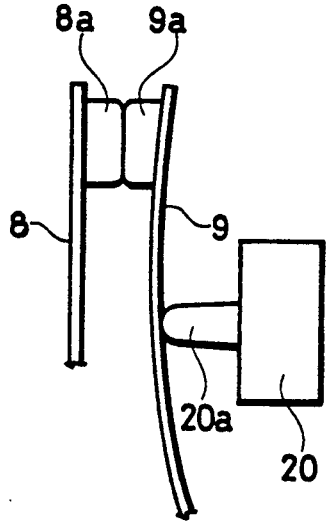
FIGS. 5A, 5B and 5C views explaining a contacting operation between a fixed contact point and a movable contact point of the electromagnetic relay shown in FIG. 3.

Referring to FIG. 3, operations according to one embodiment of the present invention will be described. When the iron core 3 is magnetized by applying current to the magnetic coil 1, one end portion **5*a* of the armature 5 is attracted by the magnetic force and then attached to the top end pole-face 3*a* of the iron core 3. As the armature 5 rotates, the pressing portion 20*a* of the electric insulating card 20 presses the movable contact plate 9 and displaces the same to keep the fixed contact point 8*a* and the movable contact point 9*a* in a contact state. The contact state is shown in FIG. 5A. The contact pressure between the fixed contact point 8*a* and the movable contact point 9*a*** is set to be in the range from 10 to 20 gf. As long as the contact pressure is within the range, contact resistance between the two contact points is small, so that good electric connection can be obtained.

Figure 5B:
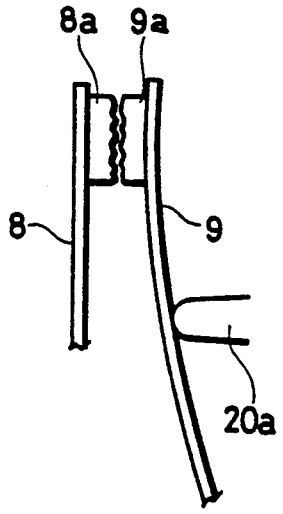

At the start of use of the electromagnetic relay, the contact pressure between the fixed contact point 8*a* and the movable contact point 9*a* is within the predetermined range. However, as the switching operation of the contact points is repeated during a long-term use, the contact portions of the fixed contact point 8*a* and the movable contact point 9*a* are abraded as shown in FIG. 5B. Since the pressing stroke of the pressing portion 20*a* of the electric insulating card 20 is constant, abrasion of the fixed contact point 8*a* and the movable contact point 9*a* causes the contact pressure between both the contact points to be reduced, whereby contact resistance thereof is increased. As a result, the fixed contact point members 8 and 8*a* and the movable contact point members 9 and 9*a* overheat because of Joule heat.

The overheating of the movable contact plate 9 is transmitted to the pressing portion 20*a* of the electric insulating card 20 through the heat conduction. In other words, when the fixed contact point 8*a* and the movable contact point 9*a* are abraded to reduce the contact pressure between the contact points, so that the contact points overheat, the pressing portion 20*a* of the electric insulating card 20 correspondingly overheats. As described above, the pressing portion 20*a* of the electric insulating card 20 is previously subjected to the shape memory processing. Accordingly, when the temperature of the pressing portion 20*a* reaches about 80° C. or above, the pressing portion 20*a* changes its shape from that shown in FIG. 4A into that shown in FIG. 4B.

Figure 5C:
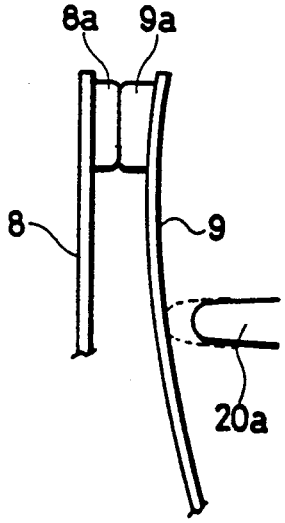
Figure 2A:
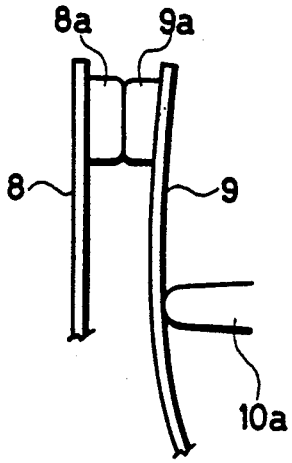
FIG.2A PRIOR ART
FIGS. 2A and 2B are views explaining a contacting operation between a fixed contact point and a movable contact point of the electromagnetic relay shown in FIG. 1.
Figure 2B:
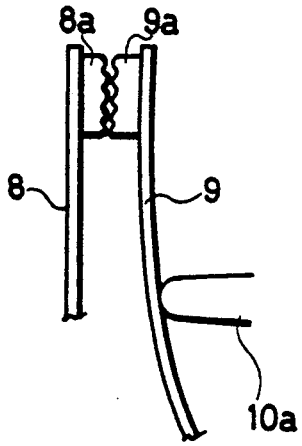
FIG.2B PRIOR ART

The pressing portion 20*a* increases in length by $\Delta L$ after the restoration of the shape as compared with that before the restoration of the shape. As a result of the increased length of the pressing portion 20*a*, the movable contact plate 9 approaches the fixed contact plate 8 as a whole. Accordingly, with the fixed contact point 8*a* and the movable contact point 9*a* being in contact with each other, the contact pressure between the contact points is increased, so that the contact resistance between the contact points is reduced. As a result, the overheating of the contact points generated due to the abrasion of the fixed contact point 8*a* and the movable contact point 9*a* is eliminated to restore the normal temperature. This state is shown in FIG. 5C.

As the foregoing, according to the present invention, when the fixed contact point 8*a* and the movable contact point 9*a* are abraded during the long-term use, whereby the contact pressure between the contact points is reduced, the pressing portion 20*a* of the electric insulating card 20 changes its shape by exerting the shape memory effect to restore the contact pressure between the fixed contact point 8*a* and the movable contact point 9*a* into the invention, a long-life electromagnetic relay durable for long-term use can be obtained.

While in the above described embodiment, only the pressing portion 20*a* of the electric insulating card 20 is formed of the shape memory resin, the entire electric insulating card 20 may be formed of the shape memory resin. In addition, shape memory alloy can be used in place of the shape memory resins.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electromagnetic relay comprising:

an electromagnetic section including an electromagnet and an armature movable by the attraction of said electromagnet, switch section including a fixed contact point member and a movable contact point member for switching a circuit, and a force transmitting member including a pressing portion to abut against said movable contact point member and an attaching portion fixed to said armature, thereby displacing said movable contact point member as said armature moves, to come into contact with said fixed contact point member, the pressing portion of said force transmitting member being formed of a shape memory material restoring a previously memorized shape at or above a predetermined temperature.

2. An electromagnetic relay according to claim 1, wherein said shape memory material is resin.

3. An electromagnetic relay according to claim 1, wherein said pressing portion of said force transmitting member is formed of shape memory resin restoring a shape at or above a predetermined temperature so as to increase contact pressure between said movable contact point member and said fixed contact point member.

4. An electromagnetic relay according to claim 3, wherein said shape memory resin restores a shape at or above a temperature of 80° C.

5. An electromagnetic relay according to claim 3, wherein said shape memory resin restores its shape at or above a temperature of 80° C. to maintain the contact pressure between said movable contact point member and said fixed contact point member within a range from 10 to 20 gf.

* * * * *